US008509679B2

(12) United States Patent
Casagrande et al.

(10) Patent No.: US 8,509,679 B2
(45) Date of Patent: Aug. 13, 2013

(54) APPARATUS AND METHODS FOR MODIFYING AN OPERATIONAL BEHAVIOR OF A RECEIVING DEVICE

(75) Inventors: Steven M. Casagrande, Castle Rock, CO (US); Jason Michael Anguiano, Castle Rock, CO (US); William Norris Moran, Highlands Ranch, CO (US); Michael J. Cavanaugh, Englewood, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 839 days.

(21) Appl. No.: 12/574,953

(22) Filed: Oct. 7, 2009

(65) Prior Publication Data

US 2011/0081855 A1 Apr. 7, 2011

(51) Int. Cl.
*H04H 20/74* (2008.01)

(52) U.S. Cl.
USPC ..... 455/3.06; 455/124

(58) Field of Classification Search
USPC ..... 455/3.06, 3.01, 3.02; 725/2, 63, 725/87, 100
See application file for complete search history.

(56) References Cited

U.S. PATENT DOCUMENTS

2004/0107436 A1* 6/2004 Ishizaki ..... 725/36
2009/0228932 A1* 9/2009 Hayes et al. ..... 725/63

* cited by examiner

*Primary Examiner* — Tu X Nguyen
(74) *Attorney, Agent, or Firm* — Seed IP Law Group PLLC

(57) ABSTRACT

A receiving device receives one or more signals, each signal including transponder identifying information. The receiving device processes the transponder identifying information to determine which signals are receivable by the receiving device. Based upon the receivable signals, the receiving device modifies its operational behavior accordingly.

22 Claims, 4 Drawing Sheets

APPARATUS AND METHODS FOR MODIFYING AN OPERATIONAL BEHAVIOR OF A RECEIVING DEVICE

BACKGROUND

In satellite broadcast systems, spotbeam transponders allow the ability to target signals to a specific geographic area, whereas a broadbeam signal carries signals often intended for a much larger geographic area. For example, a broadbeam signal may carry television programming intended for the entire continental United States, whereas a spotbeam signal may be targeted over the Denver area and carry programming specific to the Denver area. In some cases, spotbeams may be utilized to target signals over geographic areas that are not generally served by the rest of the transponders from a satellite. For example, spotbeams may be utilized to target the Alaskan, Hawaiian and Puerto Rican areas which are outside of the continental United States.

In these situations, some satellite receivers may be configured with a small satellite dish and may only be able to receive the spotbeam signals. In other situations, the satellite receivers may be configured with a larger satellite dish and may be able to receive both the spotbeam signal and the broadbeam signal, e.g. the Continental United States (hereinafter "CONUS") signal. It is desirable for a satellite receiver to operate differently depending on which signals are receivable by the satellite receiver.

BRIEF DESCRIPTION OF THE DRAWINGS

The same number represents the same element or same type of element in all drawings.

DETAILED DESCRIPTION OF THE DRAWINGS

Described herein are systems, methods and apparatus for modifying an operational behavior of a receiving device. A receiving device receives one or more signals, each signal including transponder identifying information. The receiving device processes the transponder identifying information to determine which signals are receivable by the receiving device. Based upon the receivable signals, the receiving device modifies its operational behavior accordingly.

In one embodiment, a satellite communication network includes at least one broadbeam transponder signal and at least one spotbeam transponder signal. Each transponder emits a signal including transponder identifying information, such as an identifying code, a frequency, a satellite transmitting the signal and the like. It is to be appreciated that satellite signals may be additionally identified using other information embedded within the signal which is not specifically enumerated herein. The transponder identifying information will be hereinafter referred to as a "transponder identifier".

The satellite receiver stores information that identifies attributes of each transponder signal. For example, the attributes may differentiate the broadbeam transponder signals from the spotbeam transponder signals. In at least one embodiment, the attributes are stored in a network information table (NIT). A satellite receiver may process the NIT to identify the attributes for a particular transponder identifier. The satellite receiver processes the transponder identifier to determine whether it is receiving the broadbeam signal and/or the spotbeam signal. In at least one embodiment, the broadbeam signal is not being received by the receiving device, then the receiving device may modify its operational behavior and enter a spotbeam configuration. For example, the satellite receiver may filter a list of services to remove those services that are available on the broadbeam signal, presenting the user with the applicable services available through the spotbeam signal which the user may then access.

The techniques illustrated herein will be described in reference to a satellite communication network. More particularly, the techniques described herein are described in the context of a satellite television broadcast system that utilizes both broadbeam and spotbeam transponders to provide television programming in various geographic areas. However, the techniques described herein are not limited to satellite television receivers and may be readily adapted and deployed in any type of communication system utilizing multiple transponders. For example, the techniques described herein may be utilized in a system having a combination of terrestrial and satellite transponders.

Figure 1:
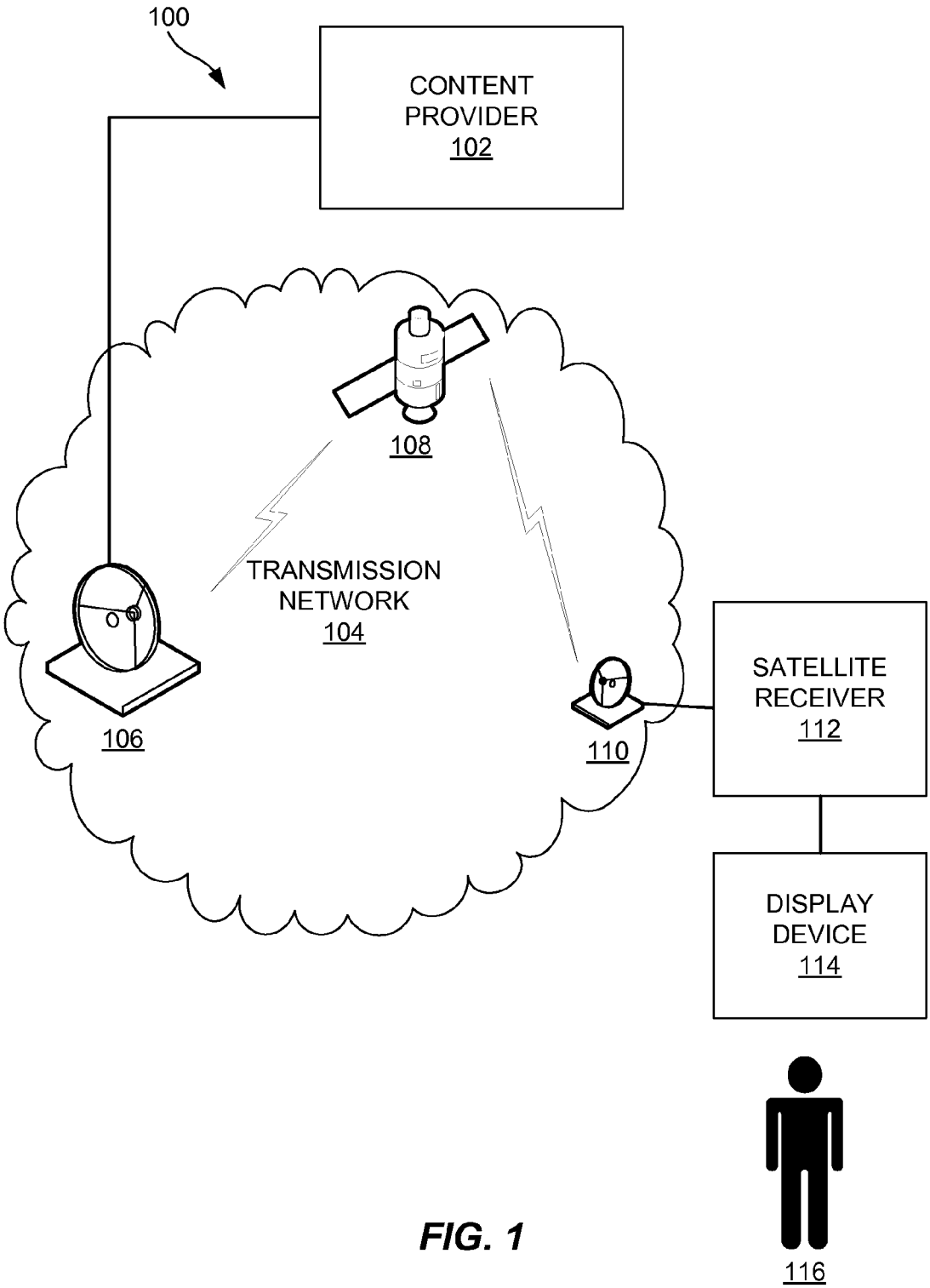
FIG. 1 illustrates an embodiment of a satellite broadcast system.

FIG. 1 illustrates an embodiment of a satellite broadcast system 100. The satellite broadcast system 100 includes a content provider 102, a transmission network 104, a satellite receiver 112 and a display device 114. The transmission network 104 includes an uplink and broadcast system 106, a satellite 108 and a satellite receive antenna 110. Each of these components will be discussed in greater detail below. The satellite broadcast system 100 may include other elements, components or devices not illustrated for the sake of brevity.

Satellite broadcast system 100 includes a content provider 102 in signal communication with an uplink system 106 of a transmission network 104. The content provider 102 provides the uplink system 106 with television programs that are transmitted to the satellite receiver 112 for viewing by the user 116 on the display device 114. More particularly, the satellite broadcast system 100 comprises a satellite 108 in signal communication with the uplink system 106. The satellite 108 broadcasts television programs received from the uplink system 106. A satellite antenna 110 receives the television program broadcast from the satellite 108 through a wireless communication link. The satellite antenna 110 is in signal communication with the satellite receiver 112 and provides the satellite receiver 112 with the received satellite signals. The signals are received by the satellite receiver 112, processed and output for presentation by the display device 114 for viewing by the user 116. While the satellite signals are described in the context of television programming, the received signals may also comprise audio data and/or data services, depending on desired design criteria.

In at least one embodiment, the satellite antenna 110 includes a satellite antenna reflector that collects signals and reflects the signals towards a low noise block (LNB) downconverter or low noise block feedhorn (LNBF) downconverter. The LNB receives the signals, down converts the signals and transmits the signals to the satellite receiver 112 for further processing. The satellite receiver 112 then processes the signal to extract selected programming for output to the display device 114. This configuration of the satellite antenna 110 is often referred to as a "satellite dish" or "dish antenna". However, it is also to be appreciated that the satellite antenna 110 may be another type of antenna configuration, such as a phase array antenna, depending on desired design criteria.

In at least one embodiment, the satellite antenna 110 may be configured to receive signals from multiple transponders. For example, Ku band satellites transmit information through 12 to 48 transponders, each at a different frequency. In some cases, the satellite antenna 110 may receive signals from transponders on multiple satellites at different orbital locations. For example, the satellite antenna 110 may be orientated to receive signals from a first satellite 108 located at orbital position 129° and from a second satellite 108 located at orbital position 119°. Further, each of the transponder signals on a given satellite 108 may not be available in all geographic locations. For example, some transponders of the satellite 108 may be assigned to transmit broadbeam signals (e.g., CONUS signals) while other transponders may be assigned to transmit spotbeam signals, which are typically transmitted over a smaller geographic area than the broadbeam signal. Thus, in a spotbeam configuration, multiple transponder frequencies may be reused in multiple geographic areas to transmit different data to each area.

As described above, the satellite receiver 112 receives one or more transponder signals from one or more satellites 108. Each transponder signal may transmit different services available to the user 116 through the satellite receiver 112. If the satellite receiver 112 is unable to receive a particular transponder signal, then the satellite receiver 112 may be unable to offer a particular service to the user 116. In certain situations, it may be desired for the behavior of the satellite receiver 112 to be different depending on which transponder signals that the satellite receiver 112 is capable of receiving at a particular location.

In at least one embodiment, signals received by the satellite receiver 112 include information embedded within the signal that identifies the transponder transmitting the signal. For example, transponders across multiple satellites may be numbered. In some embodiments, transponder identifying information may specify a frequency of the signals or the like. It is also appreciated that any combination of information that uniquely identifies a transponder may be utilized in accordance with the techniques described herein.

The transponder identifiers may then be utilized to determine which data the satellite receiver 112 is capable of receiving from the transmission network 104. For example, the transponder identifiers, as referenced in an NIT, may be associated with attributes regarding the transponder signal, such as whether a particular signal is a broadbeam signal or a spotbeam signal. In at least one embodiment, the NIT may identify a geographic location associated with the transponder signal. For example, some signals may be associated with a broad area, such as the CONUS signal, whereas other transponder signals may be associated with specific geographic areas, such as Alaska, Hawaii, Puerto Rico and the like.

The satellite receiver 112 may then process the attributes to determine which transponders it is currently receiving from the transmission network 104. Based upon which transponders the satellite receiver 112 receives, the satellite receiver 112 configures its operational behavior accordingly. For example, the satellite receiver 112 may build an NIT that identifies which services are available on which transponders of the transmission network 104. If specific services are not available because the satellite receiver 112 is not receiving the corresponding transponder signal, then the satellite receiver's 112 behavior may change to account for the lack of availability of these services.

For example, the transmission network 104 may transmit a set of CONUS channels on a broadbeam signal. Additionally, the transmission network 104 may transmit a set of specific channels on a spotbeam signal available in Alaska. If the broadbeam signal is not being received by the satellite receiver 112, then the list of CONUS channels may not be output by the satellite receiver 112 for presentation to the user 116. Thus, the satellite receiver 112 changes its operational behavior such that the user 116 is not presented with channels in an electronic programming guide that they are unable to receive through the satellite receiver 112. Other operational behavior changes include filtering download and data services. In at least one embodiment, the satellite receiver 112 may also modify its operational behavior to skip over the unavailable channels during channel surfing operations by the user 116.

If the user 116 subsequently installs a larger satellite dish that is capable of receiving the CONUS signal, then the satellite receiver 112 is configured to dynamically update its operational behavior accordingly. For example, the satellite receiver 112 may modify the electronic programming guide to present the CONUS channels which were previously not receivable by the satellite receiver 112. Advantageously, the techniques described herein allow a service provider to distribute similar satellite receivers 112 to many users and allow each satellite receiver 112 to dynamically modify its operational behavior based on the signals receivable by the satellite receiver 112.

Figure 2:
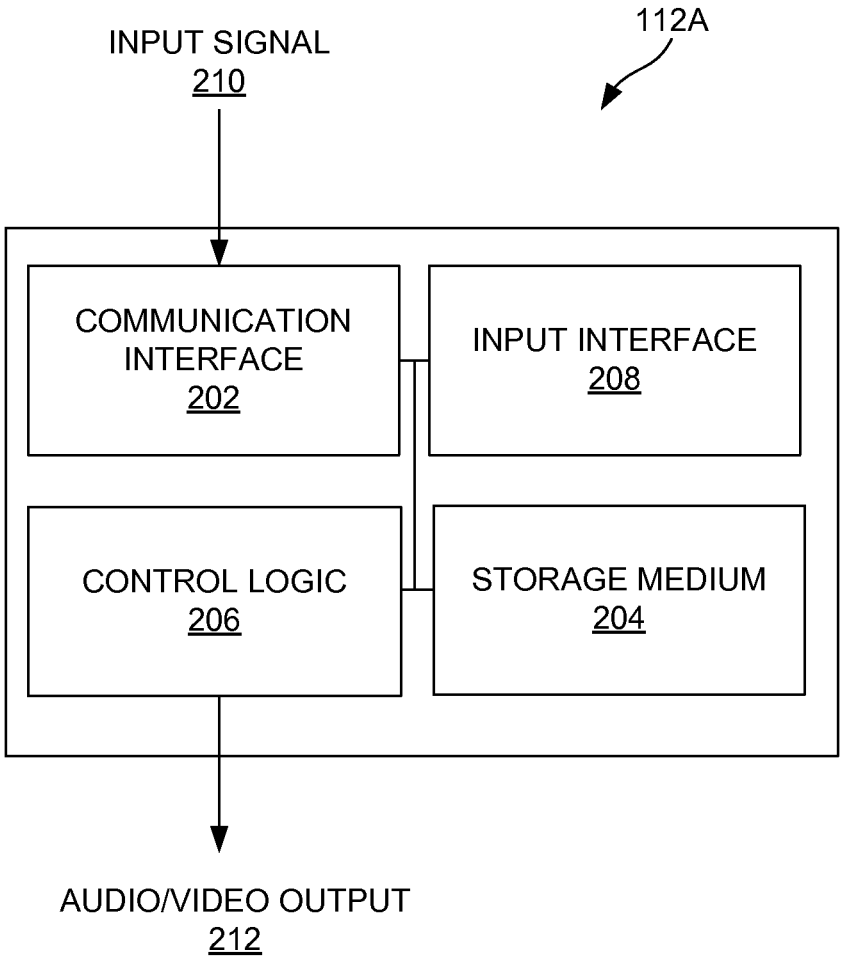
FIG. 2 illustrates an embodiment of a satellite receiver of FIG. 1.

FIG. 2 illustrates an embodiment of a satellite receiver of FIG. 1. FIG. 2 will be discussed in reference to the satellite broadcast system 100 illustrated in FIG. 1. The satellite receiver 112A includes a communication interface 202, a storage medium 204, control logic 206 and an input interface 208. Each of these components will be discussed in greater detail below. The satellite receiver 112A may include other elements, components or devices which are not illustrated for the sake of brevity.

The communication interface 202 is operable to receive an input signal 210 from the satellite antenna 110 (see FIG. 1). More particularly, in at least one embodiment, the communication interface 202 receives and tunes a television signal including television programming from the input signal 210. The input signal 210 may correspond with a single transponder signal from the satellite 108. In at least one embodiment, the communication interface 202 may comprise multiple tuners, utilized by the satellite receiver 112A to output and/or record multiple television programs simultaneously.

The storage medium 204 is operable to store settings and other data of the of the satellite receiver 112A. The stored data may be utilized by the control logic 206 to operate the satellite receiver 112A. For example, the storage medium 204 may store an NIT that identifies which services are available on various transponders of the transmission network 104 (see FIG. 1). In at least one embodiment, the storage medium 204 is operable to store data identifying a configuration of the satellite receiver 112A. As described above, the operational behavior of the satellite receiver 112A may change depending on which transponders the satellite receiver 112A is capable of receiving. The storage medium 204 may store data that identifies a present configuration of the satellite antenna 110A as determined by the control logic 206. The configuration identification process is described in greater detail below.

The storage medium 204 may comprise any type of memory appropriate for storing data utilized to control the operation of the satellite receiver 112A. Exemplary embodiments of the storage medium 204 include semiconductor random access memory (RAM), flash memory, magnetic memory and the like. In some embodiments, the storage medium 204 may comprise any combination of the different types of storage mediums depending on desired design criteria.

The input interface 208 is operable to wirelessly receive data from a remote control (not shown in FIGS. 1 and 2). The input interface 208 may communicate with a remote control utilizing any type of IR or RF communication link. In at least one embodiment, the input interface 208 receives a key code from a remote control and responsively provides the key code to the control logic 206 for processing. In some embodiments, the input interface 208 may receive positional information from a scrolling device of a remote control, e.g., a touch pad, scroll wheel or the like. The data received from the remote control may be utilized by the control logic 206 to control the output of content by the control logic 206. Some of the data received by the input interface 208 may request to view particular channels, electronic programming guide data, menus and the like.

The control logic 206 is operable to control the operation of the satellite receiver 112A. The control logic 206 may be a single processing device or a plurality of processing devices that cooperatively operate to control the operation of the satellite receiver 112A. The control logic 206 may include various components or modules for processing and outputting audio/video content. Exemplary components or modules for processing audio/video content include a demodulator, a decoder, a decompressor, a conditional access module and a transcoder module.

The control logic 206 coordinates reception of the input signal 210 by the communication interface 202 and the processing of data contained therein. In at least one embodiment, the control logic 206 is operable to generate an audio/video output 212 based on the input signal 210, e.g., extract selected audio/video content for display by the associated display device 114. If the storage medium 204 is operable to persistently store received audio/video content for subsequent viewing, then the control logic 206 is also operable to retrieve stored video content from the storage medium 204 to generate the audio/video output 212 for display by the display device 114. The display device 114 then presents the audio/video output 212 to the user 116.

The control logic 206 may incorporate circuitry to output the audio/video streams in any format recognizable by the display device 114 including composite video, component video, Digital Visual Interface (DVI), High-Definition Multimedia Interface (HDMI), 1394 and WiFi. The control logic 206 may also incorporate circuitry to support multiple types of these or other audio/video formats. In at least one embodiment, the satellite receiver 112A may be integrated with the display device 114 and the control logic 206 may be operable to control the presentation of the audio/video output 212 by the display device 114. In some embodiments, the control logic 206 is further operable to output user interface menus and other information to allow the user 116 to view an electronic programming guide, set preferences of the satellite receiver 112, set recording timers, modify recording timers and the like In at least one embodiment, the control logic 206 is operable to process identifiers within a received transponder signal to identify which transponders the satellite receiver 112A is receiving. More particularly, the control logic 206 may utilize the transponder identifier to identify attributes of the received transponder signals. For example, the control logic 206 may identify whether the satellite receiver 112A is receiving only broadbeam signals, only spotbeam signals or a combination of spotbeam and broadbeam signals.

Based upon processing of the attributes, the control logic 206 identifies an operational behavior configuration of the satellite receiver 112. For example, a first configuration may be associated with reception of only a broadbeam signal, a second configuration may be associated with reception of only a spotbeam signal and a third configuration may be associated with reception of both broadbeam and spotbeam signals. In some embodiments, there may be specific configurations associated with the reception of particular spotbeam signals. In other words, the satellite receiver 112A may operate differently depending on what signals it is capable of receiving from the satellite 108. The control logic 206 then modifies the operational behavior of the satellite receiver 112A based on the processing of the attributes.

In at least one embodiment, the control logic 206 filters a list of services available through the satellite receiver 112A depending on the identified operational behavior. For example, the control logic 206 may filter out channels from the electronic programming guide if the filtered channels are available on transponders which the satellite receiver 112A is not receiving. Similarly, if other services, such as download services, push video on demand (VOD) services, targeting services and the like are not available via the receiver transponder signals, then the operational behavior of the satellite receiver 112A may be modified to denote the unavailability of such services.

In at least one embodiment, an appearance of a graphical user interface of the satellite receiver 112A may be modified based on the identification of the received transponders. For example, if the satellite receiver 112A is receiving Puerto Rico spotbeam signals then the user interface may be changed to show a localized version intended for viewing by users in Puerto Rico.

In some scenarios, multiple versions of a similar service may be available to the satellite receiver 112A across multiple transponders of the transmission network 104 (see FIG. 1). For example, a CONUS feed of a channel may be carried on a broadbeam signal, whereas a localized version of the channel may be carried on a spotbeam signal. The localized channel may carry the same programming but at different times that align better with the local time in the geographic area associated with the spotbeam signal. In at least one embodiment, the satellite receiver 112A may receive both the spotbeam signal and the broadbeam signal and the control logic 206 may filter the CONUS feed of the channel since the spotbeam version of the channel is also available.

In some embodiments, processing of the transponder identifiers and/or attributes may identify where the satellite receiver 112A is physically located. For example, a satellite receiver 112A receiving an Alaskan spot beam is most likely physically located in Alaska. The control logic 206 may thus modify the operational behavior of the satellite receiver 112A to localize the interface, settings, available programming and the like. In at least one embodiment, a language of the satellite receiver 112A user interface may be updated based on processing of the attributes associated with the transponder signals. For example, a service provider may provide service across multiple countries using a common broadbeam signal and a plurality of spotbeam signals available for each country. The detection of a particular spotbeam signal by the control logic 206 may identify the country where the box is physically located, and hence, the proper language for the satellite receiver 112A.

In at least one embodiment, the control logic 206 utilizes the processing of the attributes associated with the transponder identifiers to implement a reverse blackout. In the reverse blackout situation, a user 116 is allowed to view programming if they are within a particular geographic area and are excluded from viewing the programming if they are located outside of the geographic area. Thus, the control logic 206 may process the transponder identifiers and/or attributes to determine whether the user 116 is allowed to view particular programming. For example, the programming may be carried on the broadbeam signal but viewing of the programming may be limited to a one or more geographic areas. The control logic 206 may process the transponder identifiers and the NIT to determine whether the satellite receiver 112A is receiving a spotbeam signal associated with the geographic area. If the spotbeam signal is receivable by the satellite receiver 112A, then the control logic 206 authorizes the output of the restricted programming contained in the broadbeam signal. However, if the spotbeam signal is not receivable by the satellite receiver 112A, then the control logic 206 does not authorize the output of the restricted programming.

In at least one embodiment, the control logic 206 performs the processing of the transponder identifiers and the corresponding attributes during a set up procedure and identifies the operational behavior of the satellite receiver 112A accordingly. In at least one embodiment, the set-up process may be initiated by the user 116 (see FIG. 1). In some embodiments, the set-up process may be initiated by control logic 206 upon initial boot up. In some embodiments, the control logic 206 may periodically perform operations to process the identifiers in the transponder and the corresponding attributes to dynamically modify the operational behavior of the satellite receiver 112A accordingly.

In at least one embodiment, the attributes are described in a descriptor within an NIT. Particular attributes of a transponder signal may be mapped to identifying information regarding the transponder signal. Thus, the control logic 206 may identify whether a particular transponder signal is a spotbeam or a broadbeam. In some embodiments, the control logic 206 may further identify the particular region associated with a spotbeam.

Figure 3:
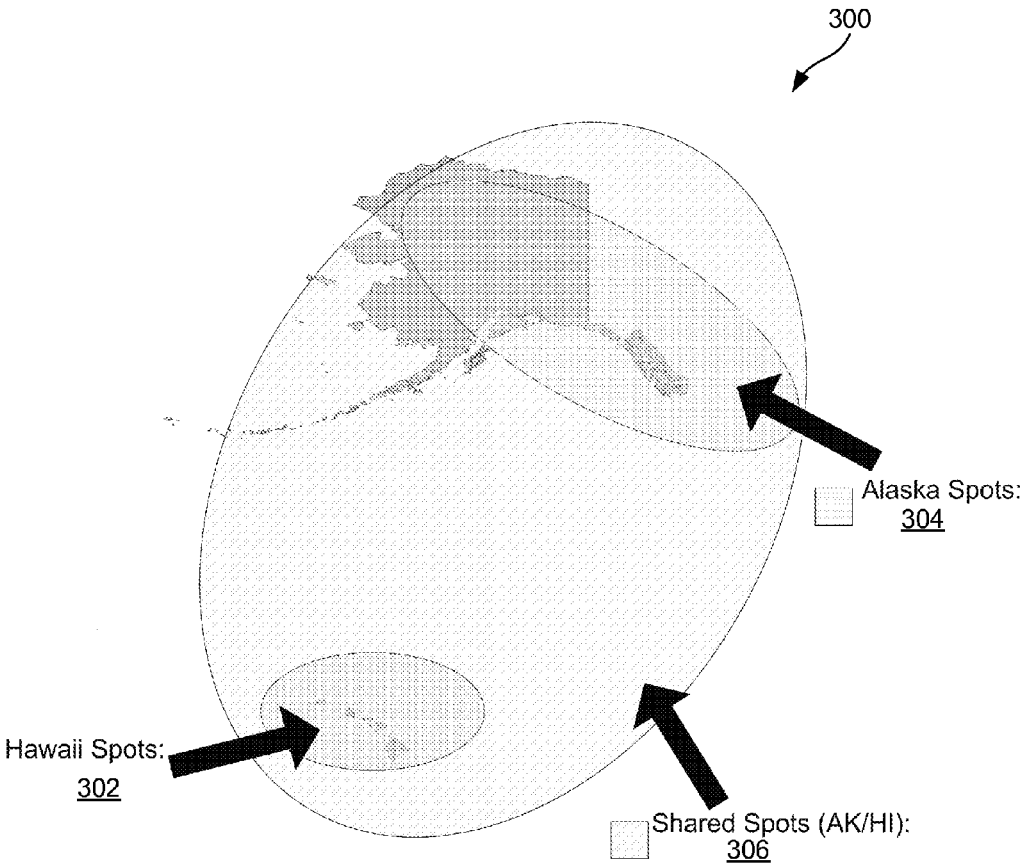
FIG. 3 illustrates a map of non-continental United States regions associated with embodiments of varying spotbeams.

FIG. 3 illustrates a map 300 of non-continental United States regions associated with embodiments of varying spotbeams. Normally, a spotbeam transponder is down linked to one geographic region. However, there are special cases where a single uplink frequency is turned around on the satellite 108 (see FIG. 1) and down linked to more than one geographic region, effectively creating a virtual superspot that covers multiple regions. This scenario is illustrated in FIG. 3. In the map 300, there is a first set of spot beams 302 physically transmitted over a geographic area covering Hawaii. There is also a second set of spot beams 304 transmitted over a geographic area covering Alaska. Additionally, there is a third set of spotbeams 306 that are transmitted over a physical area geographically covering both Alaska and Hawaii.

In at least one embodiment, the descriptors in the NIT may be utilized to identify various spotbeam transponder signals. Thus, if the spotbeam descriptor for a transponder signal has a value greater than zero, then the transponder signal is a spotbeam signal. Thus, a value of 0x0000 may identify that the transponder signal is not a spotbeam signal, but rather a broadbeam signal. Each unique value of the descriptors may identify which region(s) are associated with the spotbeam. Table #1 illustrates one embodiment of an abbreviated NIT having spotbeam identifiers. It is to be appreciated that an NIT would include other information not illustrated below for the sake of brevity.

TABLE #1

Example NIT Table

| SPOTBEAM TRANSPONDER FREQUENCIES | REGIONS(S) | SPOT REGION IDENTIFIERS |
|---|---|---|
| 2, 3, 5, 9, 13 | CONUS | 0x0000 |
| 26 | AK | 0X0001 |
| 23, 25 | HI | 0x0002 |
| 4, 12, 27, 29, 31 | AK, HI | 0X0003 |
| 1, 7 | PR | 0X0004 |

In the illustrated embodiment of Table #1, each bit represents a specific region associated with particular spotbeam signals. For example, the control logic 206 identifies that it is receiving transponder frequency 26, but is not receiving any other transponder frequencies. By processing the above referenced table, the control logic 206 may identify that the satellite receiver 112A is receiving solely the Alaskan spotbeams and may modify its operational behavior to match an Alaskan spotbeam configuration.

As described above, for non-CONUS locations, e.g., Alaska, Hawaii and Puerto Rico, a given satellite receiver 112A may be able to receive just spotbeam signals or spotbeam signals and broadbeam signals depending on various factors. For example, factors affecting the reception of the signals may include the physical location of the satellite antenna 110 as well as the size of the satellite antenna 110. For example, a large satellite antenna 110 may receive both broadbeam and spotbeam signals whereas a smaller satellite antenna may receive only the spotbeam signals. Table #2 illustrates an embodiment of three use cases for a given satellite receiver 112A in the United States.

TABLE #2

Use Cases

| | | Transponders Received | | Activation, | |
|---|---|---|---|---|---|
| Location | Satellite Dish | CONUS | NON-CONUS Spotbeams | EPG, Download, Targeting | Notes |
| Inside CONUS | Large or Small | YES | NO | Default configuration | This is the standard CONUS installation and the satellite receiver sees the standard CONUS transponders and any visible spotbeams. Out of CONUS services (e.g., services available only in Alaska or Hawaii) are not authorized for the |

TABLE #2-continued

| Use Cases | | | | | |
|---|---|---|---|---|---|
| | | Transponders Received | | Activation, | |
| Location | Satellite Dish | CONUS | NON-CONUS Spotbeams | EPG, Download, Targeting | Notes |
| | | | | | satellite receiver and are not displayed to the user. |
| Outside CONUS (e.g., AK, HI and PR) | Large | YES | YES | Default configuration | The satellite receiver sees the CONUS transponders and configures according to the default CONUS configuration. Because the receiver is out of CONUS, it is authorized to receive and output the NON-CONUS services. In one embodiment, the receiver may filter out duplicate CONUS and non-CONUS services (e.g., a channel carried on a broadbeam transponder and also carried on a spotbeam transponder). |
| Outside CONUS (AK, HI and PR) | Small | NO | YES | Out of CONUS Configuration | The receiver identifies that it can only see the non-CONUS spotbeams and removes CONUS channels from the guide. |

As illustrated in Table #2, if the satellite receiver 112A sees the broadbeam signals, then the satellite receiver 112A enters a standard configuration. However, if the satellite receiver 112A does not see the broadbeam signals, then it enters a special spotbeam configuration. Thus, in at least one embodiment, services may be filtered by the satellite receiver 112A if such services are available though the broadbeam signal. As described above, the control logic 206 may take other steps to modify its operational behavior according to the above use cases depending on desired design criteria.

Figure 4:
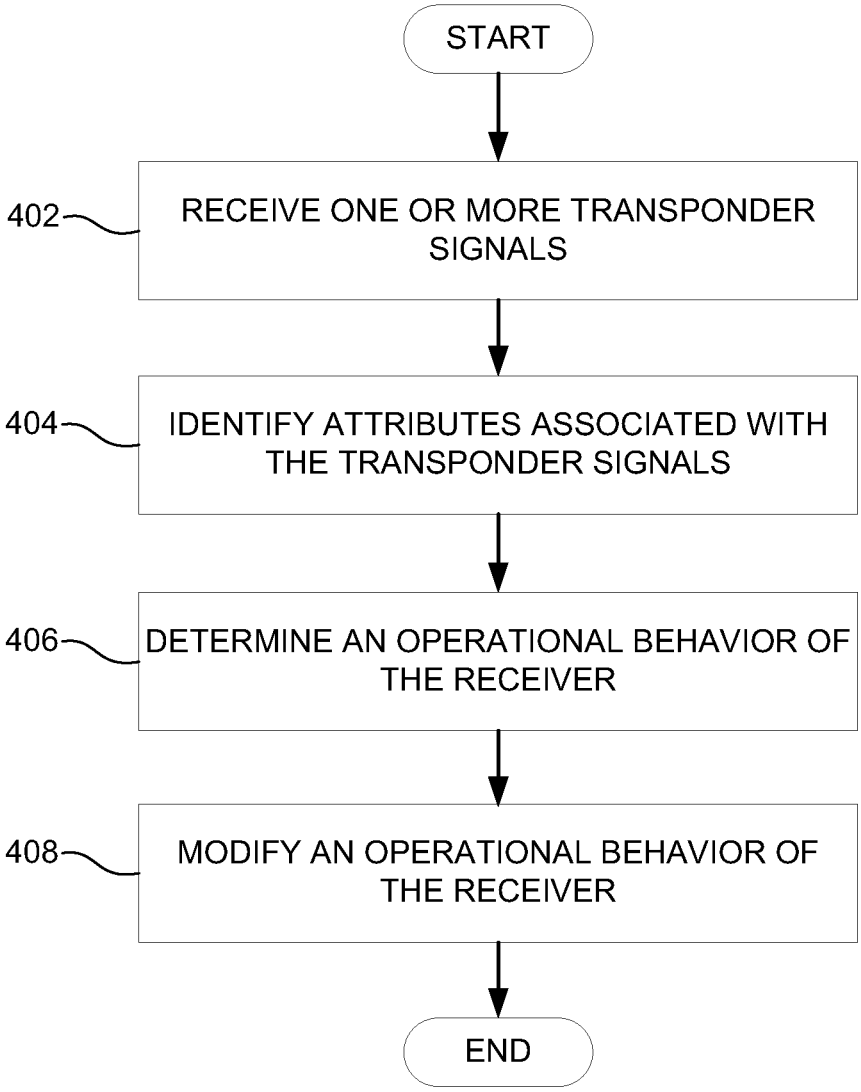
FIG. 4 illustrates an embodiment of a process for configuring a receiver.

FIG. 4 illustrates an embodiment of a process for configuring a receiver. The process of FIG. 4 is described in the context of a satellite receiver but may also be utilized for other communication networks utilizing multiple transponders. The process of FIG. 4 may include other operations not illustrated for the sake of brevity.

The process includes receiving one or more transponder signals (operation 402). Each transponder signal includes transponder identifying information, such as a unique identifier, a frequency identifier or the like. In some embodiments, the satellite signals may include one or more broadbeam signals, one or more spotbeams signals or any combination thereof.

The process further includes identifying attributes of the transponder signals based on the transponder identifying information (operation 404). In one embodiment, operation 404 includes identifying whether the transponder signals are broadbeam signals or spotbeams signals. For example, an NIT table may be utilized, as described above, to identify attributes of the broadbeam signals.

The process further includes determining an operational behavior of the satellite receiver based on the identified attributes of the transponder signals (operation 406). In at least one embodiment, operation 406 may include determining whether the satellite receiver is receiving any broadbeam signals. If the satellite receiver is receiving a broadbeam signal, then it may be configured according to a default configuration. However, if the satellite receiver is not receiving a broadbeam signal, then it may be configured according to spotbeam configuration depending on which spotbeam signals the satellite receiver is receiving.

The process further includes modifying the operational behavior of the satellite receiver (operation 408). Thus, the satellite receiver may operate according to what data it is actually receiving from the satellite and may eliminate user confusion if specific services are not available when the broadbeam signal is not being received.

Although specific embodiments were described herein, the scope of the invention is not limited to those specific embodiments. The scope of the invention is defined by the following claims and any equivalents therein.

We claim:

1. A method of operating a satellite receiver, the method comprising:

receiving at least one signal in a satellite receiver, the signal including transponder identifying information;

identifying an attribute of the signal based on the transponder identifying information, the attribute identifying whether the signal is a broadbeam signal or a spotbeam signal;

identifying services to be made available at the satellite receiver based on the attribute; and modifying presentation of services to a user based on the identified services.

2. The method of claim 1, wherein the attribute further identifies a particular geographic region associated with the spotbeam signal.

3. The method of claim 1, wherein modifying presentation of services to the user further comprises:

determining whether the satellite receiver is receiving the broadbeam signal; and identifying a spotbeam configuration responsive to determining that the satellite receiver is not receiving the broadbeam signal and is receiving at least one spotbeam signal.

4. The method of claim 1, wherein the signal is a spotbeam signal, and the attribute identifies a particular geographic region associated with the spotbeam signal, and wherein modifying presentation of services to the user further comprises:

filtering a list of services available through the satellite receiver based on the geographic region.

5. The method of claim 1, wherein the signal is a spotbeam signal and wherein modifying presentation of services to the user further comprises:

filtering a list of services to remove at least one service available through a broadbeam signal.

6. The method of claim 5, wherein the at least one service comprises a television channel available through the broadbeam signal.

7. The method of claim 5, wherein the at least one service comprises a download service available through the broadbeam signal.

8. A satellite receiver comprising:

a communication interface that receives at least one signal, the signal including transponder identifying information; and control logic operable to:

identify an attribute of the signal based on the transponder identifying information, the attribute identifying whether the signal is a broadbeam signal or a spotbeam signal;

identify an operational behavior of the receiver based on the attribute; and modify an operational behavior of the satellite receiver.

9. The satellite receiver of claim 8, wherein the control logic is operable to determine whether the communication interface is receiving the broadbeam signal and identify a spotbeam configuration responsive to determining that the communication interface is not receiving the broadbeam signal.

10. The satellite receiver of claim 9, wherein the control logic is further operable to process a network information table to identify that the signal is the spotbeam signal based on the transponder identifying information.

11. The satellite receiver of claim 9, wherein control logic is further operable to filter a list of services available through the satellite receiver to remove at least one service available through the broadbeam signal.

12. The satellite receiver of claim 11, wherein the at least one service comprises a television channel available through the broadbeam signal.

13. The satellite receiver of claim 11, wherein the at least one service comprises a download service available through the broadbeam signal.

14. The satellite receiver of claim 11, wherein the at least one service comprises an audio service available through the broadbeam signal.

15. The satellite receiver of claim 11, wherein the at least one service comprises a data download available through the broadbeam signal.

16. The satellite receiver of claim 8, wherein the control logic is operable to filter a list of channels presented within an electronic programming guide of the satellite receiver based on the attribute.

17. A satellite receiver comprising:

a communication interface that receives at least one of a broadbeam signal and a spotbeam signal, each signal including transponder identifying information;

a memory operable to store a network information table, the network information table including information identifying whether a particular signal is the broadbeam signal or the spotbeam signal; and control logic operable to:

determine whether the broadbeam signal is being received by the communication interface based on the information in the network information table and the transponder identifying information; and responsive to determining that the broadbeam signal is not being received by the communication interface, modifying an operational behavior of the satellite receiver.

18. The satellite receiver of claim 17, wherein the network information table further identifies a particular geographic region associated with the spotbeam signal.

19. The satellite receiver of claim 18, wherein the control logic is further operable to filter a list of channels in an electronic programming guide based on the geographic region.

20. The satellite receiver of claim 17, wherein the control logic is further operable to filter a list of services to remove at least one service available through the broadbeam signal.

21. The satellite receiver of claim 20, wherein the at least one service comprises a television channel available through the broadbeam signal.

22. A method of operating a satellite receiver, the method comprising:

receiving at least one signal in a satellite receiver, the signal including transponder identifying information;

identifying whether the signal is a broadbeam signal or a spotbeam signal based on the transponder identifying information;

determining whether the satellite receiver is receiving the broadbeam signal;

identifying a spotbeam configuration responsive to determining that the satellite receiver is not receiving the broadbeam signal and is receiving at least one spotbeam signal; and modifying the operational behavior of the satellite receiver.

* * * * *